United States Patent [19]

Sauter

[11] Patent Number: 4,648,816

[45] Date of Patent: Mar. 10, 1987

[54] GEAR PUMP WITH RETAINING RINGS FOR THE END BUSHES

[75] Inventor: Martin Sauter, Zürich, Switzerland

[73] Assignee: Maag Gear-Wheel & Machine Company Limited, Zürich, Switzerland

[21] Appl. No.: 470,379

[22] Filed: Feb. 28, 1983

[51] Int. Cl.[4] ..... F04C 2/18; F04C 15/00

[52] U.S. Cl. ..... 418/134

[58] Field of Search ..... 418/131, 132, 134, 135

[56] References Cited

U.S. PATENT DOCUMENTS

| | | | |
|---|---|---|---|
| 1,994,786 | 3/1935 | Redfield | 418/134 |
| 3,055,308 | 9/1962 | Golfieri | 418/131 |
| 4,078,872 | 3/1978 | Teruyama | 418/132 |
| 4,268,232 | 5/1981 | Haupt | 418/135 |

FOREIGN PATENT DOCUMENTS 2432180 5/1976 Fed. Rep. of Germany .

*Primary Examiner*—John J. Vrablik

*Attorney, Agent, or Firm*—Werner W. Kleeman

[57] ABSTRACT

Two shafts each containing a gear wheel or gear are each journalled in two bearing bushes. Each bearing bush is mounted in an end or closure bush laterally inserted into a housing. The end bushes each comprise a collar at the axially inner end thereof which overlaps the inner end of the associated bearing bush. The end bushes are each secured to a respective holder or retaining ring which is received in a countersink formed in the housing and which is firmly held intermediate the housing and a cover member. Consequently, the bearing bushes may be separated from the associated shafts by axially displacing the shafts within the housing after removal of the cover members.

5 Claims, 3 Drawing Figures

GEAR PUMP WITH RETAINING RINGS FOR THE END BUSHES

BACKGROUND OF THE INVENTION

The present invention relates to a new and improved construction of a gear wheel machine, especially a gear pump for pumping polymer solutions or melts.

In its more specific aspects the invention relates to a new and improved construction of gear pump comprising a housing containing a gear space or chamber formed therein, at least two shafts extending in parallelism and through the gear chamber or space, and a gear wheel or gear is provided on each one of the shafts. End or closure bushes are inserted into the housing and laterally bound the gear chamber or space and form axial bearings for the gear wheels or gears by means of their inner end faces. There are also provided bearing bushes, each of which is inserted into a respective one of the end bushes and form a radial bearing for a respective one of the shafts, and cover members are laterally mounted on the housing and support the end bushes including the bearing bushes against an outwardly directed axial displacement.

In a gear pump of this type as known, for example, from German Patent Publication No. 2,432,180, published May 20, 1976, the outer or exterior end surfaces or faces of the end or closure bushes and the bearing bushes directly engage the cover members which are secured to the pump housing by outer screws or threaded bolts and which are screwed directly to the end bushes by inner screws or threaded bolts. When the bearing bushes are worn and have to be exchanged, the shafts including the associated gears or gear wheels, bearing bushes and end bushes can be axially pushed out of the housing after the cover members have been released. In case that the bearing bushes have become seized upon the shafts, then it may be extremely difficult to remove the same from the shafts without damaging either the shafts or the gear wheels. Above all, this is true in the event the shafts and the associated gears or gear wheels are formed in one piece. In such case the gear wheels cannot be displaced upon the shafts even after these have been removed from the housing, and thus, the gear wheels cannot be utilized to push the bearing bushes off the shaft.

SUMMARY OF THE INVENTION

Therefore, with the foregoing in mind it is a primary object of the present invention to provide a new and improved construction of gear pump, especially for pumping polymer solutions or melts, in which the exchange of the bearing bushes is facilitated even when these have become seized upon the shafts.

Another and more specific object of the present invention is directed to the provision of a new and improved construction of gear pump in which the risk of damaging the bearing surfaces on the shafts or the gears is decreased when the bearing bushes are exchanged.

Now in order to implement these and still further objects of the invention, which will become more readily apparent as the description proceeds, the gear pump of the present development is manifested by the features that, retaining or holder rings are arranged intermediate each cover member and the neighboring end bushes, which retaining or holder rings are supported at the housing against an inwardly directed axial displacement independently of the cover member and at which the adjacent end or closure bushes are mounted, and a collar is provided at each inner axial end of the end bushes, which collar engages over the inner end of the associated bearing bush.

In case that a bearing bush has become seized upon its shaft in the gear pump according to the invention, then the same can be removed from the shaft in that, after removal of the cover members, an axial pressure force is exerted from the side upon the related shaft at which the bearing bush has become seized. The bearing bush cannot follow the displacement of its shaft, since it is prevented from being displaced into the interior of the pump housing by the collar of the associated closure or end bush and the end bush itself is also prevented from being further displaced into the interior of the housing because it is secured to the retaining or holder ring. Consequently, the bearing bush and the end bush together with the retaining ring maintain their assembled or mounted positions in the housing during displacement of the shaft, which is thus released from the bearing bush which previously was seized thereto. In the event that the bearing bushes on both sides of a shaft have become seized, then the shaft is displaced first in the one axial direction and then in the other axial direction in order to separate the same in succession from the two bearing bushes.

In a preferred embodiment of gear pump according to the invention each retaining or holder ring comprises inner cylinder surfaces by means of which the retaining ring is centered at a corresponding outer cylinder surface or face formed at the adjacent end bush.

Furthermore, it is advantageous to have each retaining or holder ring overlap or engage over the outer axial end of the adjacent bearing bush. Consequently, the bearing bushes are prevented from displacement with respect to the end bushes without any participation by the cover members.

According to a further development of the inventive gear pump, each retaining or holder ring comprises an outer cylinder surface or face at which the adjacent cover member is centered by means of a corresponding inner cylinder surface or face.

Finally, at least one washer or the like may be inserted between at least one of the retaining rings and the adjacent end bushes on one side of the gear pump in order to define the axial play of the gear wheels or gears.

BRIEF DESCRIPTION OF THE DRAWINGS:

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
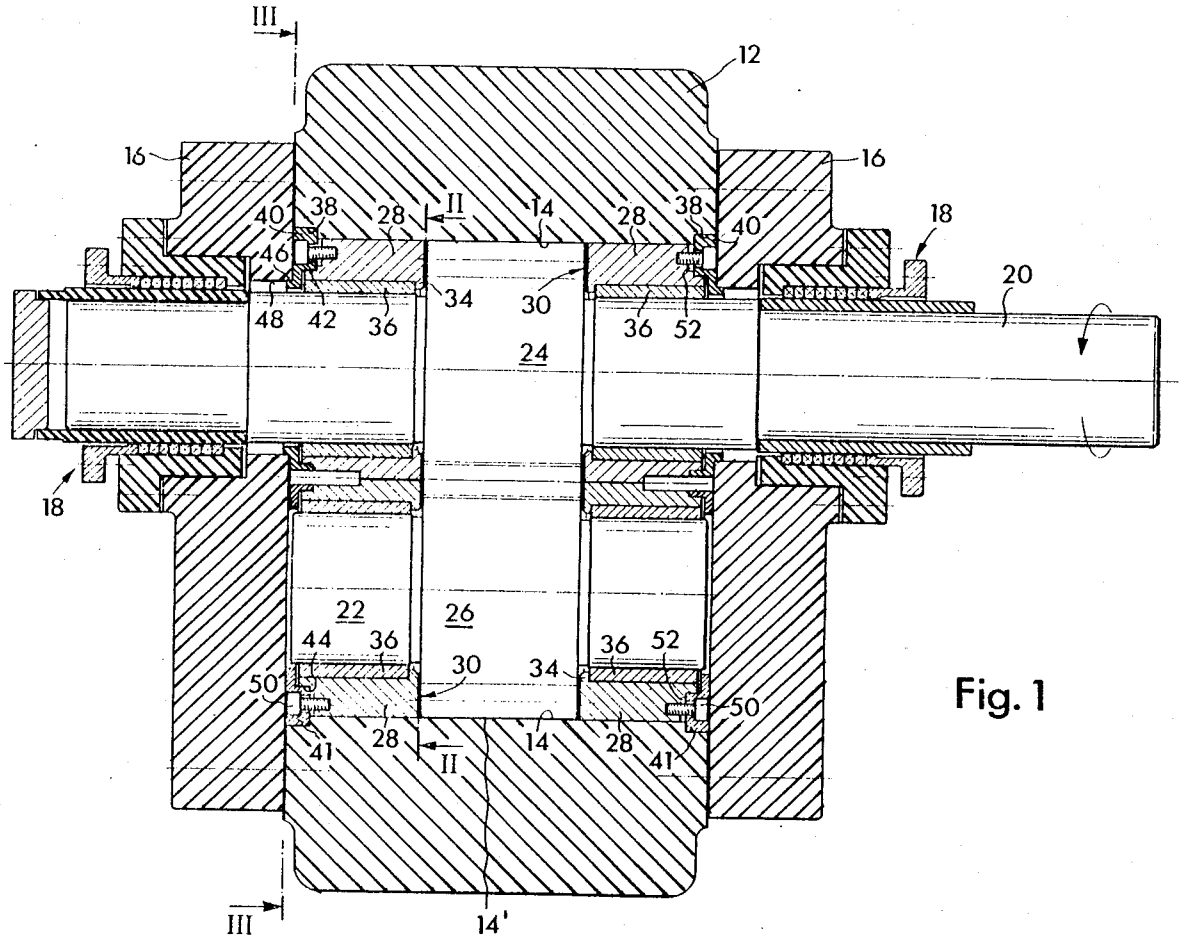
FIG. 1 is an axial section through a gear pump constructed according to the invention.
Figure 3:
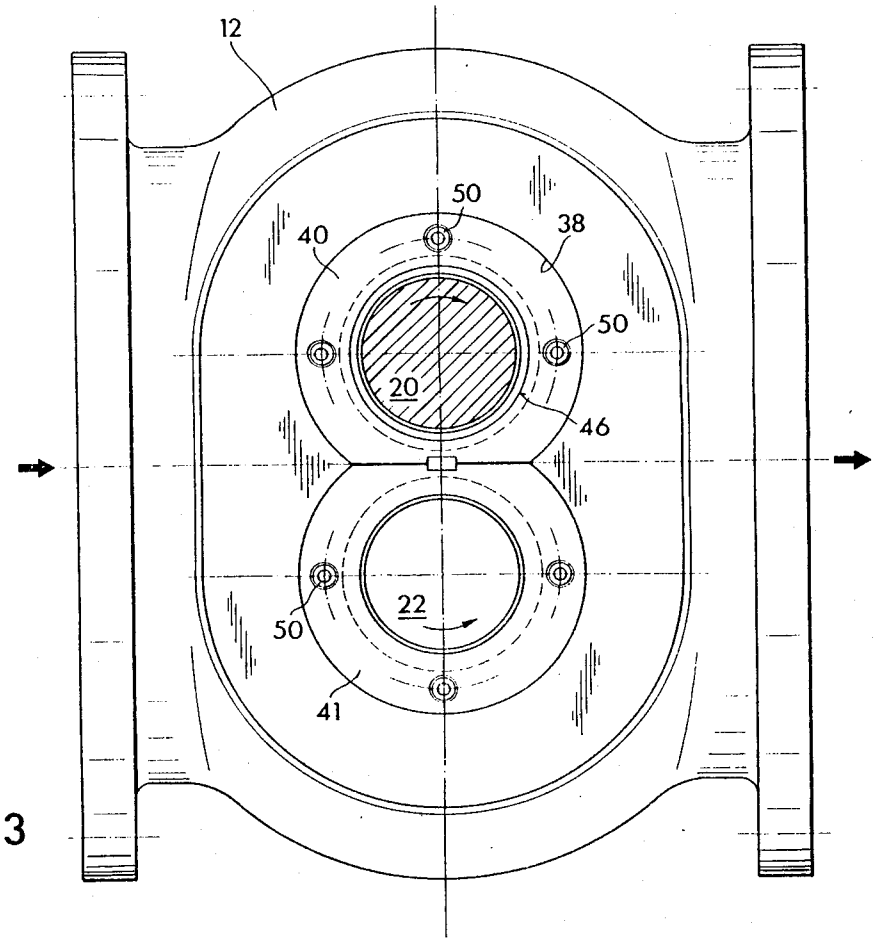
FIG. 3 is a cross sectional view taken substantially along the line III—III in FIG. 1.
Figure 2:
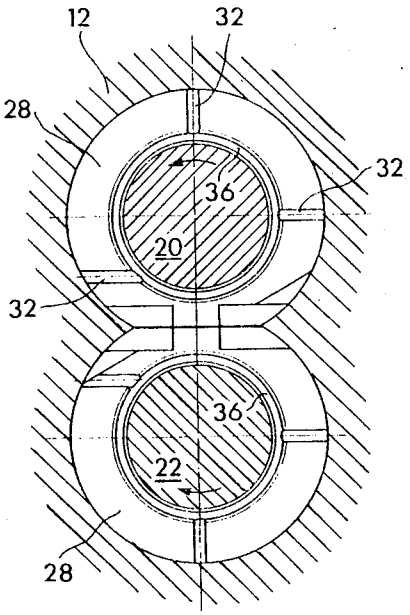
FIG. 2 is a cross sectional view taken substantially along the line II—II in FIG. 1.

Describing now the drawings, it is to be understood that only enough of the construction of the gear pump has been shown as needed for those skilled in the art to readily understand the underlying principles and concepts of the present development, while simplifying the showing of the drawings. Turning attention now specifically to FIG. 1, there has been shown a gear pump housing 12 for the illustrated gear pump. This housing 12 includes a gear wheel space or chamber 14' which is bounded or defined by two overlapping cylindrical surfaces 14 which extend in parallel to the lengthwise axis therof. Cover members 16 are firmly screwed or bolted to each end face or surface of the pump housing 12. A packing box 18 is mounted in each of the housing cover members 16 and a driving shaft 20 extends therethrough. A driven shaft 22 is arranged in parallel to the driving shaft 20 within the housing 12. A driving gear or gear wheel 24 is formed integrally with the driving shaft 20 and meshes with a driven gear or gear wheel 26 which is also formed integrally with the driven shaft 22.

Two end or closure bushes 28 are each inserted into a respective one of the cylindrical surfaces or faces 14 from the two end faces of the housing 12. On the outside the end or closure bushes 28 are substantially cylindrical; the outer diameter thereof corresponds to the diameter of the cylindrical surfaces 14. The end bushes 28 are associated in pairs, but are each flattened along a secant at the faces or sides thereof facing each other since their axial spacing from one another is smaller than their outer diameter. Each end bush 28 has an inner end face or surface 30 covered with a bearing metal which serves as an axial bearing for the adjacent gear or gear wheel 24 or 26, respectively. Grooves 32 are formed in the interior or inner end faces 30.

A collar 34 is formed at the inner or interior axial end of each end or closure bush 28. The collar 34 overlaps or engages over the axially interior or inner end face or surface of a bearing bush 36 which is shrunk or press-fitted into the respective end bush 28. The interal diameter of the collar 34 corresponds approximately to the arithmetic mean of the outer and inner diameter of the bearing bush 36, so that a portion of the inner end face or surface thereof remains uncovered. Thus, there has been assured that each of the bearing bushes 36, for example, after it has been worn out, can be urged out of the associated end bush 28 by using conventional push-off or drive-out means after the two bearing bushes 36 have been conjointly separated from the associated shaft 20 or 22, respectively, in the manner as described hereinbefore.

At both of its end faces the pump housing 12 has a countersink or recessed portion 38 following the mutually overlapping cylindrical surfaces 14, but having a larger diameter than these cylindrical surfaces 14. Each of the countersinks or recessed portions 38 receives a retaining or holder ring 40 and 41, respectively, which in its external shape is formed complementary to the respective countersink or countersink portion 38. The retaining rings 40 and 41 have a diameter and a thickness as measured in the axial direction of the housing 12 which are each smaller than the diameter or, respectively, the depth of the associated countersink 38 by a small amount which is not readily recognizable in the showing of the drawing. Each of the retaining or holder rings 40, 41 has formed at the interior or inner axial side thereof an inner cylinder surface 42 which is centered at an external cylinder surface 44 at the end bush 28 adjacent to the respective retaining ring 40, 41. Each of the retaining or holder rings 40, 41 extends further into the interior from the inner cylinder or cylindrical surfaces 42, so as to partially cover the axially external or outer end surface of the respectively associated bearing bush 36 without, however, contacting the associated shaft 20 or 22, respectively. Additionally, each of the two retaining or holder rings 40 comprises an outer or external cylindrical surface 46 at the region surrounding the driving shaft 20 and at which cylindrical surface 46 the respectively associated cover member 16 is centered by means of an inner cylindrical surface 48 formed thereat.

Each of the end or closure bushes 28 is mounted to the respectively associated retaining or holder ring 40, 41 by means of threaded bolts or screws 50, and thus, is prevented from being displaced axially into the pump housing 12. The bearing bushes 36 are also prevented from undergoing such displacement, since they are retained by the collar 34 of the respectively associated end bush 28. An axially outward displacement of the end or closure bushes 28 and the bearing bushes 36 is prevented by the respectively associated holder or retaining rings 40, 41 which themselves are retained between the respectively associated cover member 16 and the housing 12. Thus, the end bushes 28 govern the axial play of the gears or gear wheels 24 and 26.

In case this axial play is intended to be decreased then the one or the other cover member 16 is unscrewed or released so that the respectively associated retaining rings 40, 41 including the threaded bolts or screws 50 therein become accessible. These threaded bolts or screws 50 are released, the retaining rings 40 and 41 are removed, and one or a number of washers or shims 52 or the like each comprising a thin metal foil are placed upon the end bushes 28 which have become accessible by removing these retaining or holder rings 40, 41. The washers 52 or the like are provided with holes in an arrangement corresponding to the arrangement of the threaded bolts or screws 50. Therefore, the related retaining rings 40, 41 are re-mounted and tightened to the adjacent end bushes 28 by means of the threaded bolts or screws 50. When a subsequent measurement indicates that the desired axial play of the gears or gear wheels 24 and 26 has been achieved, then the removed cover member is finally re-assembled.

While there are shown and described present preferred embodiments of the invention, it is to be distinctly understood that the invention is not limited thereto, but may be otherwise variously embodied and practiced within the scope of the following claims. ACCORDINGLY,

What I claim is:

1. A gear wheel machine, especially a gear pump for pumping polymer solutions or melts, said gear wheel machine comprising:

a housing;

a gear wheel space formed in said housing;

at least two shafts extending substantially in parallel to one another and extending through said gear wheel space;

a gear wheel provided for each one of said at least two shafts and arranged in said gear wheel space;

end bushes inserted into said housing;

each of said end bushes including an inner axial end and an inner end face;

said end bushes laterally bounding said gear wheel space;

said inner end faces of the end bushes forming axial bearings for the gear wheels;

bearing bushes each inserted into a respective one of said end bushes;

each of said bearing bushes forming a radial bearing for a respective one of said at least two shafts and having an inner end;

a collar formed at said inner axial end of each one of said end bushes;

said collar engaging over said inner end of an associated one of said bearing bushes;

cover members provided for said housing;

each of said cover members being laterally secured to said housing and supporting said end bushes including said bearing bushes against an outwardly directed axial displacement;

retaining rings arranged intermediate each said cover member and an adjacent one of said end bushes;

each retaining ring being supported at said housing against an inwardly directed axial displacement independently of said cover member; and said end bushes being mounted essentially in an axially non-displaceable manner on said retaining rings.

2. The gear wheel machine as defined in claim 1, further including:

inner cylindrical surfaces provided at each one of said retaining rings;

outer cylindrical surfaces provided at each one of said end bushes; and each said retaining ring being arranged adjacent a respective one of said end bushes and being centered by means of said inner cylindrical surface thereof at said outer cylindrical surface of said end bush located adjacent thereto.

3. The gear wheel machine as defined in claim 1, wherein:

each retaining ring is arranged adjacent a respective one of said bearing bushes; and each said retaining ring engaging over an axially outer end of said adjacent one of said bearing bushes.

4. The gear wheel machine as defined in claim 1, further including:

outer cylindrical surfaces formed at said retaining rings;

inner cylindrical surfaces formed at said cover members;

each said retaining ring and a respective one of said cover members being arranged adjacent to one another; and each said cover member being centered at said outer cylindrical surface of an adjacent one of said retaining rings by means of said inner cylindrical surface thereof.

5. The gear wheel machine as defined in claim 1, further including:

at least one washer inserted between at least one of said retaining rings and said end bushes located adjacent thereto at one side of said gear wheel machine.

* * * * *